US006260298B1

(12) United States Patent
Bubits

(10) Patent No.: US 6,260,298 B1
(45) Date of Patent: Jul. 17, 2001

(54) PISTOL HAVING A FIRING BOLT SAFETY DEVICE

(75) Inventor: Wilhelm Bubits, Brunn/Gebirge (AT)

(73) Assignee: Steyr-Daimler-Puch Aktiengesellschaft, Vienna (AT)

( * ) Notice: Subject to any disclaimer, the term of this patent is extended or adjusted under 35 U.S.C. 154(b) by 0 days.

(21) Appl. No.: 09/340,426

(22) Filed: Jun. 28, 1999

(30) Foreign Application Priority Data

Jul. 14, 1998 (AT) ..... A 1213/98

(51) Int. Cl.[7] ..... F41A 17/02; F41A 17/64
(52) U.S. Cl. ..... 42/70.08; 42/70.11
(58) Field of Search ..... 42/70.08, 70.01

(56) References Cited

U.S. PATENT DOCUMENTS 4,021,955 * 5/1977 Curtis ..... 42/70 F
4,555,861 * 12/1985 Khoury ..... 42/70 F
4,658,529 4/1987 Bertolini ..... 42/70.08
4,726,136 * 2/1988 Dornaus et al. ..... 42/70.08
4,843,748 * 7/1989 Tuma ..... 42/70.08
5,419,069 * 5/1995 Mumbleau et al. ..... 42/70.11
5,438,784 * 8/1995 Lenkarski et al. ..... 42/70.02

FOREIGN PATENT DOCUMENTS 4013124 10/1991 (DE) .

* cited by examiner

*Primary Examiner*—Charles T. Jordan
*Assistant Examiner*—Kyongtack K. Mun
(74) *Attorney, Agent, or Firm*—Bachman & LaPointe, P.C.

(57) ABSTRACT

A pistol, comprising a housing which contains a trigger device and a slide which slides on this housing and contains a barrel and a breech, in which case the breech is provided with a firing bolt which can be driven by a mainspring. In order to provide entirely safe protection against access, the breech has a hole which runs transversely with respect to the firing direction, in which hole a locking bolt can be moved and can be rotated, which locking bolt has a head which is accessible from the outside and, in the locked position, projects into the movement path of the firing bolt. To this end, the head of the locking bolt has at least one tab on its external circumference, and the breech has at least one recess on the internal circumference of the hole, which recess holds the tab when the locking bolt is in the open position.

9 Claims, 3 Drawing Sheets

PISTOL HAVING A FIRING BOLT SAFETY DEVICE

BACKGROUND OF THE INVENTION

The invention relates to a pistol which comprises a housing which contains a trigger device and a slide which slides on the housing and contains a barrel and a breech, in which case the breech is provided with a firing bolt which can be driven by a mainspring, and a trigger is operatively connected to the trigger device such that, when the trigger is operated, the firing bolt is released, and the breech of the pistol has a hole which runs transversely with respect to the firing direction and in which a locking bolt can be moved and can be rotated, which locking bolt has a head which is accessible from the outside and, in the locked position, projects into the movement path of the firing bolt.

Owing to the repeated incidence of accidents and incidents, in which children or youths use fire arms without permission, even the lawmakers are increasingly demanding that access to firearms be made more difficult. Long guns are normally stored in boxes that can be locked, but it has not been possible to implement this for pistols, which are frequently kept in desks or bedside tables. The usual solution thus comprises additional devices which enclose and fill out the trigger guard, and which are locked by means of a lock, thus making it impossible to move the trigger. Apart from the fact that such devices are bulky and impractical, they do not provide complete safety. Since there are intermediate elements between the trigger and the firing bolt, the firing bolt can nevertheless be released, for example if the pistol is dropped. Furthermore, this does not prevent the slide from being removed and a shot being fired. There is therefore a requirement for a real firing bolt lock with final safety, which also involves protection against access.

In the case of a pistol which is disclosed in DE 40 13 124 A1, drop protection is provided in the form of a locking piece which can be moved transversely with respect to the firing direction. However, this method of operation means that the firing bolt has to be able to move in the vertical direction, and, furthermore, it is not positively locking.

U.S. Pat. No. 4,658,529 A discloses a pistol in which a locking bolt, which is arranged in the transverse direction and can be moved, has an oblique rib which, when locked, engages in a cutout on the shank of the firing bolt. Owing to the rib, the locking movement of the locking bolt is considerable and the locking bolt cannot be rotated, so that it cannot be fixed in the locked position. In consequence, protection against access can be achieved only with major effort. Furthermore, this relates to a pistol with a hammer action, in which the mainspring acts against the firing direction. This firing bolt protection device cannot be used in a pistol having a mainspring that acts in the firing direction.

The object of the present invention is to provide a means of protection against access for pistols of this generic type, which avoids all the disadvantages mentioned and which offers a very high level of safety against use by unauthorized persons, with very little physical complexity.

SUMMARY OF THE INVENTION

The foregoing object is achieved according to the present invention wherein the locking bolt can be locked in the locked position by turning it, and in that the head of the locking bolt has at least one tab on its external circumference, and the breech has at least one recess on the internal circumference of the hole, which recess holds the tab when the locking bolt is in the open position.

Since the locking bolt can be turned, there are no movement problems involved with its operation and it can be accommodated in a very small space, as a result of which the movement of the locking bolt need be only very short. The tab on the head of the locking bolt and the recess on the internal circumference of the hole allow the locking bolt to be fixed in the locked position safely, cheaply, and in a particularly space-saving manner.

Within the context of the invention, the recess may extend over the entire depth of the hole, and the tab may have a paint mark on its outward-facing side. It is thus possible to see whether or not the weapon is locked. In this case, it is practical for manufacture and use for the head to have a collar internally, adjacent to the tab.

It is a major advantage of the invention that, owing to its indifference with regard to movement, it can be used with widely differing pistols and in various arrangements. Operation is particularly convenient if the hole runs vertically from the top of the breech. The weapon can then be locked from above, in which case the safety of a cylinder lock can easily be made use of. Installation in the bolt has in this case been found to be particularly space-saving.

BRIEF DESCRIPTION OF THE DRAWINGS

The invention will be described and explained in the following text with reference to illustrations, in which.

DETAILED DESCRIPTION

Figure 1:
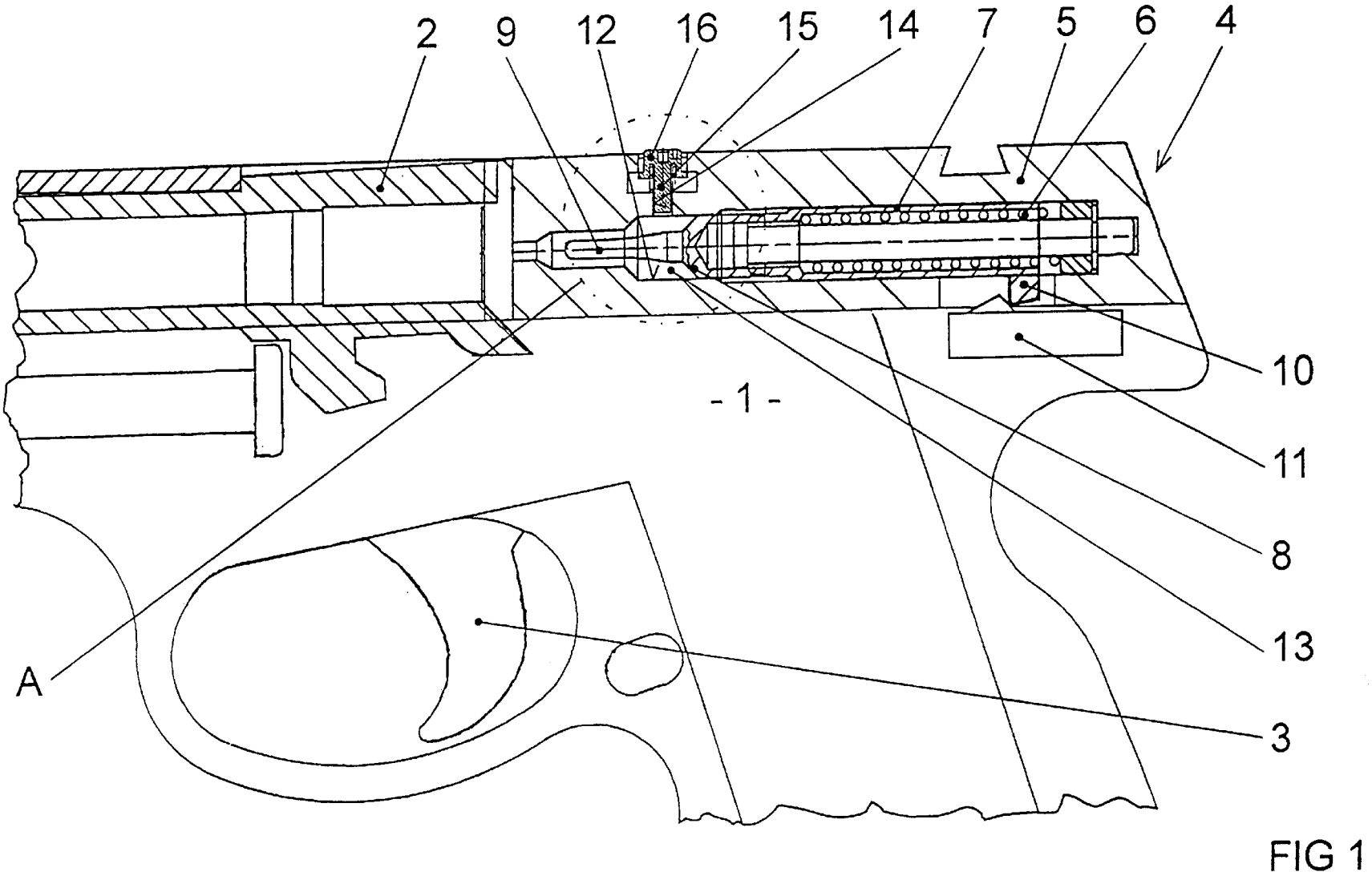
FIG. 1 shows a side view of a pistol according to the invention.

FIG. 1 shows the essential part of a pistol according to the invention, to be precise a grip 1, made, for example, of plastic, above which a slide 4 with a barrel 2 is guided such that it can be moved. A trigger 3 projects downward out of the upper part of the grip 1. The trigger 3 is mounted in the interior of the grip 1 such that it can pivot. Inside the slide, there is a breech 5, in whose interior a firing bolt 7 (on which a mainspring 6 acts) can be moved in the longitudinal direction. This firing bolt 7 merges at the front, on a shoulder 8, into the firing pin 9 and has a downwardly projecting lug 10 which, in order to fire a shot, is released by means 11 which are operated by the trigger 3, may differ widely, and are thus not shown in detail.

The firing bolt 7 is guided in a longitudinal hole 12 and, in its cocked position, there is a free space 13 in front of its shoulder 8. A transverse hole 14 comprising lower portion 14*a*, enlarged middle portion 14*b* and upper portion 14*c* originates from this free space 13 and is provided with a locking bolt 15 which has a head 16 (which is accessible from the outside), and can be moved in front of the shoulder 8 into the free space 13 in order to form a firing bolt protection device.

Figure 2:
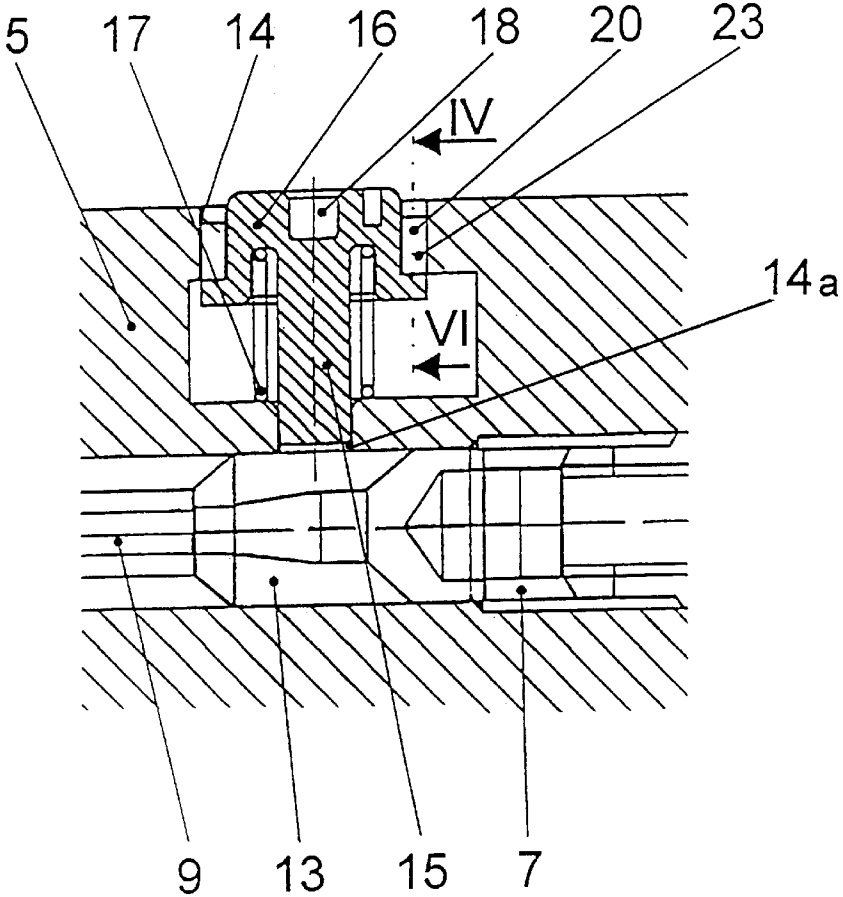
FIG. 2 shows the detail A from FIG. 1, in the open position.

FIG. 2 shows the locking bolt 15, with its head 16, enlarged. The transverse hole 14 in the breech 5 may be arranged vertically (as in FIG. 2), but may just as well be arranged horizontally. The locking bolt 15 and the transverse hole 14 interact like a bayonet fitting. The head 16 is pushed outward by a compression spring 17. A hole 18 of any desired shape is provided in the head 16, into which an appropriate key can be inserted, in order to operate the lock.

Figure 3:
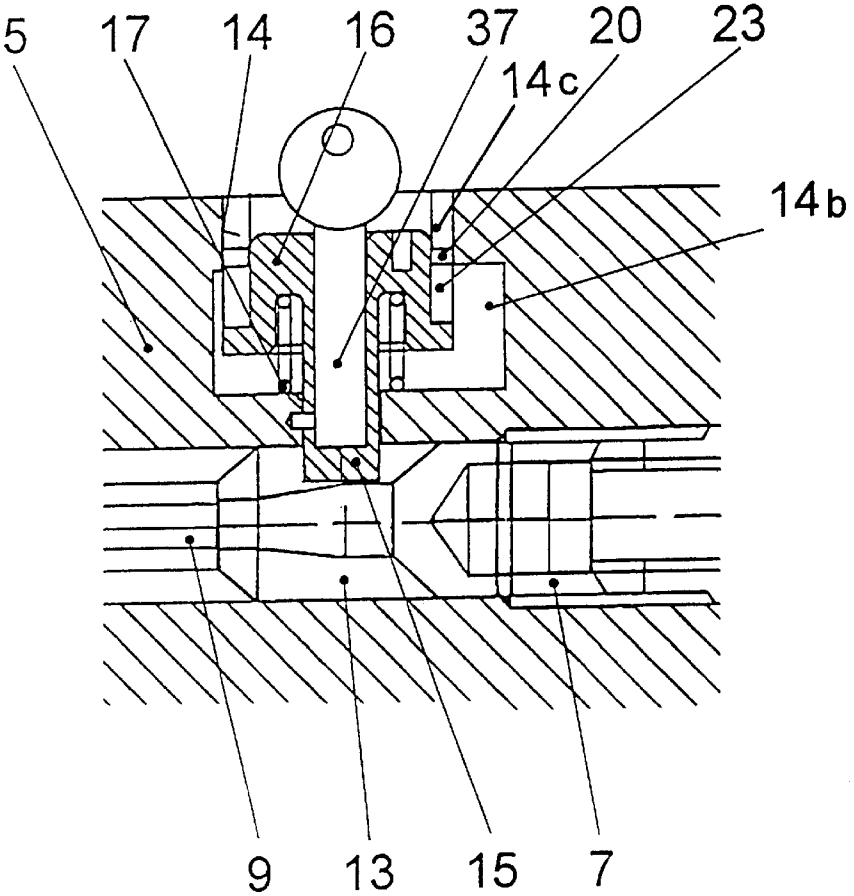
FIG. 3 shows the detail A from FIG. 1, in the locked position.
Figure 4:
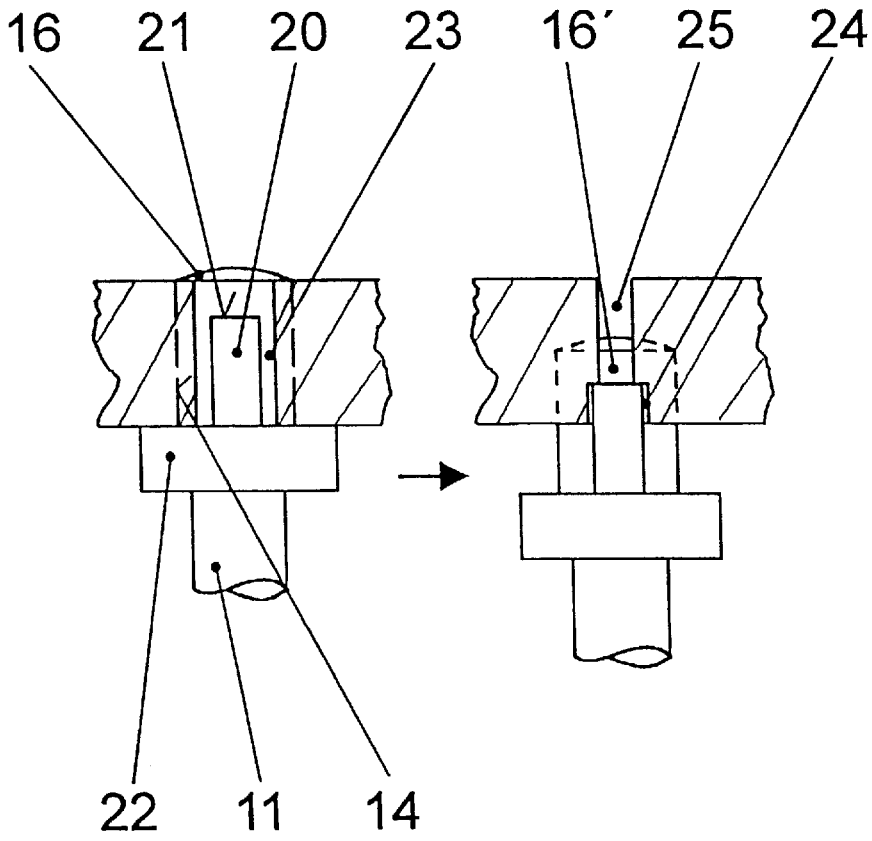
FIG. 4 shows a cross section along IV—IV, enlarged and developed.

The bayonet-fitting-like interaction of the head 16 with the upper portion 14*c* of hole 14 is evident in conjunction with the schematic FIG. 4, in which the head 16 is shown in the open position on the left-hand side, and the same head 16' is shown in the closed position on the right-hand side. The head 16 has at least one tab 20, but preferably, as in the illustrated exemplary embodiment, two tabs offset through 180 degrees. Their outward-pointing corner surface 21 has a red paint mark. The cylindrical part of the head 16 is provided with a collar 22 before its transition into the locking bolt 15. Two recesses 23, which are likewise offset through 180 degrees and extend over the entire depth of the upper portion 14*c* of the transverse hole 14, are provided in said transverse hole 14. If the head 16 is now turned until the tabs 20 are no longer opposite the recess 23, but are opposite a further recess 24 that is considerably shallower, then this angular position is associated with a different travel position of the bolt 15, namely the locked position (FIG. 3). The only purpose of the small opening 25 is to make the red part 21 of the tab visible from the outside. The further recess 24 is not required, but is used for accurate positioning in the locked position.

In FIG. 3, in contrast to FIG. 2, a cylinder lock 37 is provided instead of the hole 18 in the head 16, which cylinder lock 37 can be locked with a key and interacts in a known manner with a corresponding recess in the transverse hole 14.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A pistol, comprising a housing which contains a trigger device, a slide which slides on the housing, the slide contains a barrel and a breech, wherein the breech is provided with a firing bolt driven by a mainspring, a trigger operatively connected to the trigger device for releasing the firing bolt along a movement path in a firing direction, the breech having a transverse hole which runs transversely with respect to the firing direction of the firing bolt, and in which a locking bolt can be moved, which locking bolt includes a head which is accessible from outside the slide and is selectively movable first rotatably and thereafter axially from a locked position wherein the locking bolt projects into the movement path of the firing bolt to an unlocked position wherein the locking bolt is retracted from the movement path, wherein the locking bolt has at least one tab selectively received in a recess in the transverse hole when the locking bolt is in the unlocked position.

2. The pistol as claimed in claim 1, wherein the hole includes an upper portion and the recess extends over the entire depth of the upper portion, and the tab has a paint mark on its outward-facing side.

3. The pistol as claimed in claim 1, wherein the hole runs vertically from the top of the breech.

4. The pistol as claimed in claim 1, wherein the locking bolt holds a locking cylinder of a cylinder lock.

5. The pistol as claimed in claim 1 wherein said transverse hole comprises an upper portion in which the head is axially moved and an enlarged portion in which the head is rotatably moved.

6. The pistol as claimed in claim 5, wherein the upper portion is provided with the recess and the head is provided with the at least one tab which is received in the recess when the head is moved axially.

7. The pistol as claimed in claim 1, wherein the head has a collar, internally and adjacent to the tab.

8. The pistol as claimed in claim 7, wherein the hole includes a middle portion and the collar is located in the middle portion when the locking bolt is in the locked position.

9. The pistol claimed in claim 8, wherein the locking bolt is spring loaded for biasing the locking bolt away from the movement path.

* * * * *